United States Patent [19]

Raue et al.

[11] Patent Number: 4,849,306

[45] Date of Patent: Jul. 18, 1989

[54] DRY TONERS CONTAINING METHINEFANAL PIGMENTS

[75] Inventors: Roderich Raue; Hubertus Psaar; Horst Berneth, all of Leverkusen, Fed. Rep. of Germany

[73] Assignee: Bayer Aktiengesellschaft, Leverkusen, Fed. Rep. of Germany

[21] Appl. No.: 158,520

[22] Filed: Feb. 22, 1988

[30] Foreign Application Priority Data

Mar. 6, 1987 [DE] Fed. Rep. of Germany ..... 3707262

[51] Int. Cl.[4] ..... G03G 9/10

[52] U.S. Cl. ..... 430/110; 430/107

[58] Field of Search ..... 430/107, 110

[56] References Cited

U.S. PATENT DOCUMENTS

| | | | |
|---|---|---|---|
| 4,301,227 | 11/1981 | Hotta et al. | 430/106 |
| 4,680,245 | 7/1987 | Suematsu et al. | 430/110 |
| 4,734,350 | 3/1988 | Lin et al. | 430/110 |

OTHER PUBLICATIONS

Derwent Accession No. 84–279 376, Questel Telesystemes (WPIL) Derwent Publications Let., London *Zusammenfassung* & JP–A–59 172 655 (Sumitomo).

*Primary Examiner*—John L. Goodrow

*Attorney, Agent, or Firm*—Sprung, Horn, Kramer & Woods

[57] ABSTRACT

Dry toners for developing latent electrostatic images in electrostatic recording and printing methods contain, as charge-control substance, a pigment of the formula $$F^+A^- \quad (I)$$

in which

F represent a cationic radical of a methine dyestuff and $A^-$ represents an anion of a heteropolyacid based on tungsten and/or molybdenum with phosphorus, silicon, vanadium, cobalt, aluminum, manganese, chromium and/or nickel or a copper(I) hexacyanoferrate anion.

9 Claims, No Drawings

DRY TONERS CONTAINING METHINEFANAL PIGMENTS

The invention relates to a dry toner for developing latent electrostatic images in electrostatic recording and printing methods, which contains, as charge-control substance, a pigment of the formula $$F^+A^- \quad \text{(I)}$$

in which

F represents the cationic radical of a methine dyestuff and $A^-$ represents an anion of a heteropolyacid based on tungsten and/or molybdenum with phosphorus, silicon, vanadium, cobalt, aluminium, manganese, chromium and/or nickel or a copper(I) hexacyanoferrate anion.

A preferred group of these cationic methine dyestuffs corresponds to the formula

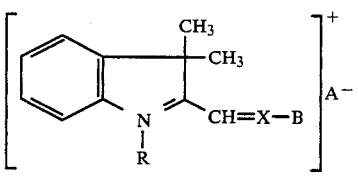

(II)

in which $A^-$ has the abovementioned meaning, and

R represents alkyl or aralkyl,

X represents CH or N and

B represents a radical of the formulae

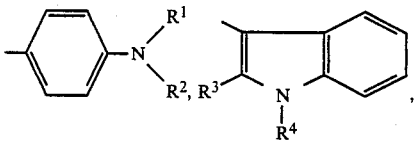

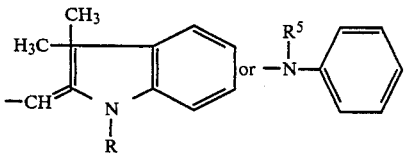

in which $R^1$ denotes alkyl or aralkyl, $R^2$ denotes alkyl, aralkyl or aryl, or $R^1$ and $R^2$, independently of one another, denote, through linking with the o-position of the phenylene radical, the members of a partly hydrogenated five- or six-membered ring, or $R^1$ and $R^2$ together denote the members of a five- or six-membered ring, $R^3$ denotes hydrogen, alkyl or aryl, $R^4$ denotes hydrogen, alkyl or aralkyl, and $R^5$ denotes hydrogen or alkyl, or, through linking with the o-position of the phenyl radical, the members of a partly hydrogenated 5- or 6-membered ring, and in which the alkyl, aralkyl and aryl radicals and the aromatic rings may be substituted by nonionic groups which are conventional in dyestuffs chemistry.

Examples of nonionic groups are halogen, hydroxyl, alkoxy, alkenyloxy, aryloxy, aralkoxy, cycloalkyloxy, heteryloxy, aryl, heteryl, alkylmercapto, arylmercapto, aralkylmercapto, alkylsulphonyl, arylsulphonyl, cyano, carbamoyl, alkoxycarbonyl, amino which may be substituted by 1 or 2 alkyl, cycloalkyl, aryl or aralkyl groups, acylamino, alkylcarbonyloxy and arylcarbonyloxy, and in addition, as substituents of the rings, alkyl, aryl, aralkyl, nitro, alkenyl or arylvinyl.

Alkyl represents $C_1$- to $C_{30}$-alkyl, in particular $C_1$- to $C_{12}$-alkyl.

The alkyl radicals and the alkyl radicals in alkoxy, alkylthio, alkylamino, alkanoylamino, alkylsulphonyl and alkoxycarbonyl groups may be branched and may be substituted, for example, by fluorine, chlorine, $C_1$- to $C_4$-alkoxy, cyano or $C_1$- to $C_4$-alkoxycarbonyl.

In particular, aralkyl is phenyl-$C_1$- to $C_4$-alkyl which may be substituted in the phenyl ring by halogen, $C_1$- to $C_4$-alkyl and/or $C_1$- to $C_4$-alkoxy, preferably benzyl.

In particular, cycloalkyl is cyclopentyl or cyclohexyl, each of which is optionally substituted by methyl.

In particular, alkenyl is $C_2$- to $C_5$-alkenyl which may be monosubstituted by hydroxyl, $C_1$- to $C_4$-alkoxy, cyano, $C_1$- to $C_4$-alkoxycarbonyl, chlorine or bromine. Vinyl and allyl are preferred.

In particular, halogen is fluorine, chlorine and bromine, preferably chlorine.

In particular, aryl is phenyl or naphthyl, each of which is optionally substituted by 1 to 3 $C_1$- to $C_4$-alkyl, chlorine, bromine, cyano, $C_1$- to $C_4$-alkoxycarbonyl or $C_1$- to $C_4$-alkoxy.

In particular, alkoxy is $C_1$- to $C_{12}$-alkoxy which is optionally substituted by chlorine or $C_1$- to $C_4$-alkoxy.

In particular, acyl is $C_1$- to $C_4$-alkylcarbonyl and $C_1$- to $C_4$-alkoxycarbonyl, or aminocarbonyl or aminosulphonyl which is optionally monosubstituted or disubstituted by $C_1$- to $C_4$-alkyl, phenyl or benzyl.

In particular, alkoxycarbonyl is $C_1$- to $C_4$-alkoxycarbonyl which is optionally substituted by hydroxyl, halogen or cyano.

In particular, heteryl is pyridyl, pyrimidyl, pyrazinyl, triazinyl, indolyl, imidazolyl, oxazolyl, thiazolyl, triazolyl, thiadiazolyl or tetrazolyl, each of which may be benzene-fused, and their partly hydrogenated or fully hydrogenated derivatives.

Preferred nonionic substituents of the rings are $C_1$- to $C_4$-alkyl, $C_1$- to $C_4$-alkoxy, cyano, nitro and halogen.

Together with the nitrogen atom to which they are bound, the substituents $R^1$ and $R^2$ can form, for example, a piperidine, piperazine or morpholine ring which is optionally substituted by 1 to 4 $C_1$–$C_4$-alkyl groups.

Linking of substituents $R^1$ and/or $R^2$ with the o-position of the phenylene radical or substituent $R^5$ with the o-position of the phenyl radical produces, for example, the dihydrobenzoxazine, tetrahydroquinoline or indoline ring, each of which may be substituted by 1 to 4 $C_1$–$C_4$-alkyl groups.

A preferred group amongst the abovementioned compounds corresponds to the general formula (III)

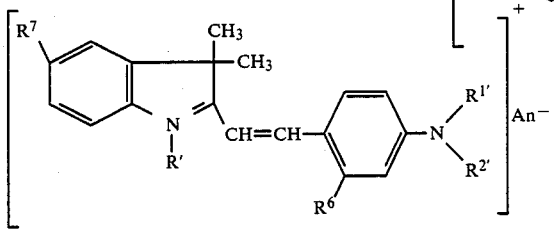

in which

R′ represents methyl or ethyl, $R^{1'}$ represents a $C_1$- to $C_4$-alkyl radical which is optionally substituted by chlorine, cyano or $C_1$–$C_4$-alkoxy, or a benzyl radical, $R^{2'}$ represents the substituents mentioned in the case of $R^{1'}$ or a phenyl radical which is optionally substituted by methyl, chlorine or $C_1$- to $C_4$-alkoxy, $R^6$ represents hydrogen, methyl, chlorine or $C_1$- to $C_4$-alkoxy, $R^7$ represents hydrogen, methyl, chlorine, $C_1$- to $C_4$-alkoxy, cyano, nitro, acetylamino, $C_1$- to $C_4$-alkylsulphonyl, phenylsulphonyl or $C_1$- to $C_4$-alkoxycarbonyl, and An− represents the anion of a heteropolyacid based on phosphorus, molybdenum, tungsten and/or silica.

A further preferred group of pigments of the formula (II) corresponds to the formula

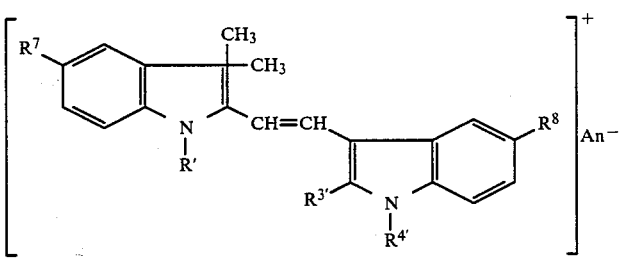

(IV)

in which $R^{3'}$ represents hydrogen, methyl or phenyl, $R^{4'}$ represents hydrogen or $C_1$- to $C_4$-alkyl which is optionally substituted by chlorine, cyano or $C_1$- to $C_4$-alkoxy, and $R^8$ represents hydrogen, methyl, chlorine or $C_1$- to $C_4$-alkoxy, and R′, $R^7$ and An− have the abovementioned meaning.

A further preferred group of compounds of the general formula (II) corresponds to the formula

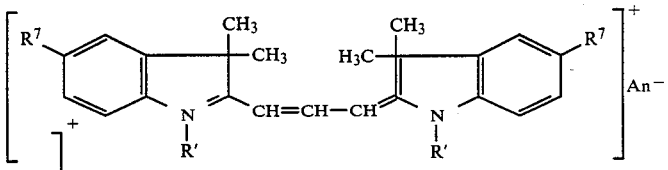

(V)

in which

R′, $R^7$ and An− have the abovementioned meaning.

A further preferred group of compounds of the formula (II) corresponds to the general formula

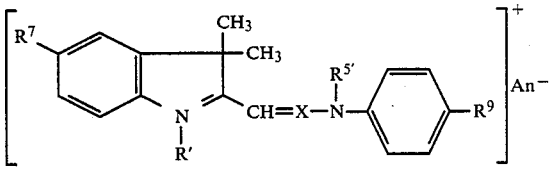

in which $R^{5'}$ represents hydrogen or a $C_1$- to $C_4$-alkyl radical which is optionally substituted by chlorine, cyano or $C_1$- to $C_4$-alkoxy, or, through ring closure in the o-position to the phenylene radical, forms, with the latter, an indoline, tetrahydroquinoline or dihydroxybenzoxazine ring which may be substituted by $C_1$- to $C_4$-alkyl, $R^9$ represents hydrogen, chlorine, methyl, $C_1$- to $C_4$-alkoxy, benzyl, benzyloxy, amino or acetylamino, and the R′, $R^7$, X and An− radicals have the abovementioned meaning.

A further preferred class of dyestuff of the formula (I) corresponds to the general formula

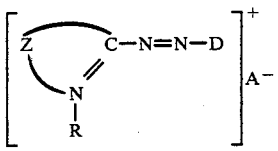

(VII)

in which

R and A− have the abovementioned meaning,

Z represents the remaining members of a triazole, thiazole, benzothiazole, thiadiazole, imidazole, benzimidazole, pyrazole, indazole, pyridine or quinoline ring, and D represents a

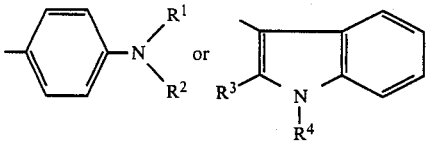

radical in which the $R^1$, $R^2$, $R^3$ and $R^4$ substituents have the abovementioned meaning, and the alkyl, aralkyl and aryl radicals, the aromatic rings and the Z-containing ring may be substituted by nonionic groups which are conventional in dyestuffs chemistry.

Of the dyestuffs of the general formula (VII), additionally preferred dyestuffs are those of the general formula

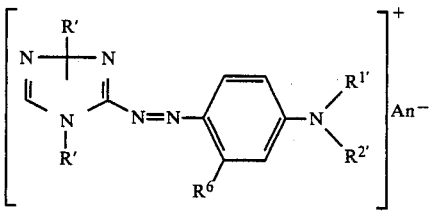

(VIII)

in which $R'$, $R^{1'}$, $R^{2'}$, $R^6$ and An have the abovementioned meanings;

dyestuffs of the formula

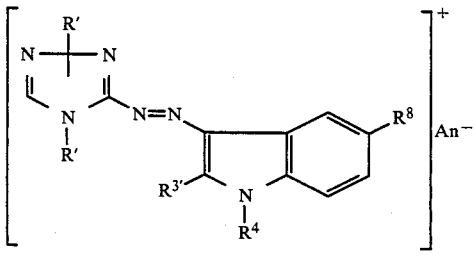

(IX)

in which $R'$, $R^{3'}$, $R^{4'}$, $R^8$ and $An^-$ have the abovementioned meanings;

dyestuffs of the formula

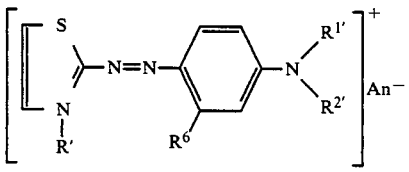

(X)

in which $R'$, $R^{1'}$, $R^{2'}$, $R^6$ and $An^-$ have the abovementioned meanings;

dyestuffs of the formula

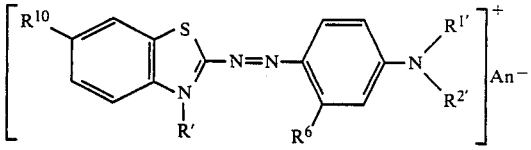

(XI)

in which $R^{10}$ represents hydrogen, methyl, chlorine, $C_1$- to $C_4$-alkoxy or $C_1$- to $C_4$-alkylcarbonylamino, and $R'$, $R^{1'}$, $R^{2'}$, $R^6$ and $An^-$ have the abovementioned meaning, and the dyestuffs of the formula

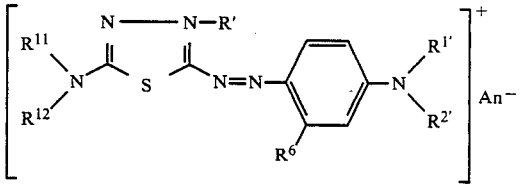

(XII)

in which $R^{11}$ and $R^{12}$ represent alkyl radicals having 1 to 6 C atoms, and $R'$, $R^{1'}$, $R^{2'}$, $R^6$ and An have the abovementioned meaning.

Of the substituents mentioned in the formulae (III) to (VI) and (VIII) to (XII), the following are of particular importance:

$R'$ methyl, $R^{1'}$ methyl; ethyl, butyl, chloroethyl, cyanoethyl and benzyl, $R^{2'}$ methyl, ethyl, butyl, chloroethyl, cyanoethyl, benzyl, phenyl, 4-methoxy-phenyl and 4-ethoxy-phenyl, $R^{3'}$ hydrogen, methyl and phenyl, $R^{4'}$ hydrogen, methyl, ethyl and cyanoethyl, $R^{5'}$ hydrogen, methyl, ethyl and the remaining members for completion of a 2-methyl-indoline, 2,3,3-trimethylindoline, tetrahydroquinoline, 2,4,4-trimethyl-tetrahydroquinoline and a dihydrobenzoxazine ring, $R^6$ hydrogen, methyl and chlorine, $R^7$ hydrogen, methyl, chlorine, cyano, methylsulphonyl, methoxy, ethoxy, methoxycarbonyl, ethoxycarbonyl, amino and acetylamino, $R^8$ hydrogen, methyl, chlorine, methoxy and ethoxy, $R^9$ hydrogen, methyl, methoxy, ethoxy, amino and acetylamino.

Of the anions $An^-$, phosphorus molybdate, phosphorus tungstate, phosphorus tungstomolybdate and silicon molybdate are particularly preferred.

Dry toners used for developing latent electrostatic images in electrostatic recording and printing methods generally contain binder resins, charge-control substances and colorants, such as pigments or soluble dyestuffs. Suitable binder resins are, for example, styrene, epoxy, phenolic, maleic and polyamide resins.

Styrene resins are, for example, styrene homopolymers or styrene copolymers with methacrylates, acrylates, chlorostyrene, α-methylstyrene, vinyl chloride or vinyl acetate.

Polycondensation resins are obtained from di- or polycarboxylic acids, such as terephthalic acid, trimellitic acid, maleic acid, fumaric acid and polyhydroxy compounds, such as 2,2-bis-(hydroxyphenyl)-propane.

The preferred weight ratio of pigment of the formula (I) to resin is 0.1 to 15, in particular 0.1 to 5, to 100 parts.

Suitable colorants are, for example, Benzidine Yellow, and phthalocyanine, quinacridone and perylene pigments.

The preferred weight ratio of colorant to resin is 1 to 20:100 parts.

The dry toners according to the invention can be produced, for example, by mixing the components in a mixer and subsequently powdering the mixture.

For production of a dry developer, the toner obtained is mixed with a carrier, for example iron powder, which can also have a coating, or with glass beads, and exhibits a strong positive chargeability compared to the carrier.

Pigments of the formula (I) have hitherto been employed for the production of liquid electrophoretic toner dispersions which are used for developing charge on zinc oxide-coated papers. This process is not applicable in modern duplicators.

The charge-control substances employed hitherto in dry toners have been dye bases. Nigrosine dye bases exhibit the disadvantage that their charging properties vary between individual production batches. Other dye bases give an unstable charge if the temperature and humidity conditions vary.

The charge-control pigments according to the invention do not have these disadvantages and give a stable charge, which makes possible the production of perfect copies even in a long-term test. They exhibit a broad range of colour shades, so that they are especially suitable for the production of coloured toners.

The charge-control substances are also suitable for the production of black toners if they are employed in combination with carbon black.

EXAMPLE 1

Preparation of the phosphorus tungstomolybdate solution 15 g of sodium hydroxide are dissolved in 2,500 ml of water, the solution is heated to 90° C., and 527.5 g of sodium tungstate+$2H_2O$, 50 g of molybdenum(VI) oxide and 63 g of disodium hydrogen phosphate are added. 49 g of concentrated hydrochloric acid and subsequently 94.5 g of 38% sodium bisulphite solution are added dropwise to the resultant solution. $SO_2$ is expelled by refluxing the mixture for 30 minutes, and the resultant solution is employed for precipitation of the dyestuffs.

Pigment preparation 16 g of the dyestuff of the formula

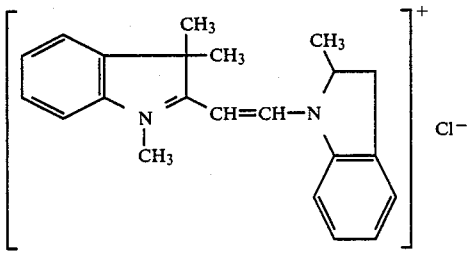

are dissolved in 2,400 ml of water at 85° C., and 0.6 g of nonylphenol, oxyethylated using 10 mol of ethylene oxide, is added. The mixture is warmed to 90° C., and 150 ml of phosphorus tungstomolybdate solution are added within 10 minutes at 90° to 95° C. After stirring the mixture for several hours, the precipitated pigment is filtered off under suction and dried. Yield: 26 g.

Preparation of the toner 100 g of styrene/n-butyl methacrylate copolymer (molecular weight 50,000) and 5 g of the phosphorus tungstomolybdate pigment whose preparation is described above, are mixed homogeneously in a mixer. After cooling, the resin is powdered in a jet mill to an average grain fineness of 12 μm. 5 g of this toner powder are charged by rotation with 95 g of a carrier material made from iron with a polymer coating, and the charge is determined by the blow-off method. It is 9.6 μC/g and is still unchanged at the same high level after 10,000 copies.

EXAMPLE 2

50 g of the cationic dyestuff of formula

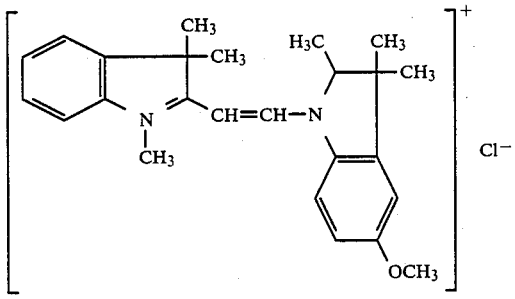

are dissolved in 1 liter of water at 90° C., 0.8 g of nonylphenol, oxyethylated using 10 mol of ethylene oxide, is added, and 700 g of sodium phosphorus tungstomolybdate solution whose preparation is described in Example 1 are added dropwise. After stirring the mixture for several hours, the precipitated pigment is filtered off under suction and dried. A yellow toner powder is prepared according to the method of Example 1, and the triboelectric charge is determined by the blow-off method. It is 3.9 μC/g.

EXAMPLE 3

50 g of the cationic dyestuff of the formula

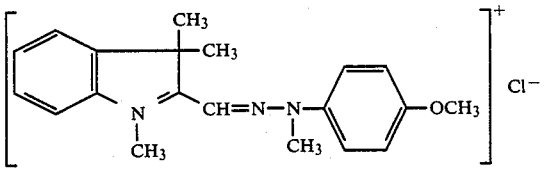

are dissolved in 1 liter of water at 90° C., 0.8 g of a non-ionic emulsifier is added, and 600 g of sodium phosphorus tungstomolybdate solution prepared by the method of Example 1 are added dropwise. The mixture is stirred at 90° C. for a further 1 hour, and the pigment is filtered off under suction whilst hot and dried in vacuo. Yield: 90.7 g.

An orange toner powder is prepared according to the method of Example 1, and the triboelectric charge is determined by the blow-off method. It is 3.2 μC/g.

Pigments made from cationic dyestuffs of the above formula in which the methoxy group in the p-position on the phenyl radical is replaced by hydrogen, methyl, ethoxy, an acetylamino or a phenylazo group are prepared in the same way. The toner powders prepared using these pigments likewise exhibit a good triboelectric charge.

EXAMPLE 4

30 g of the cationic dyestuff of the formula

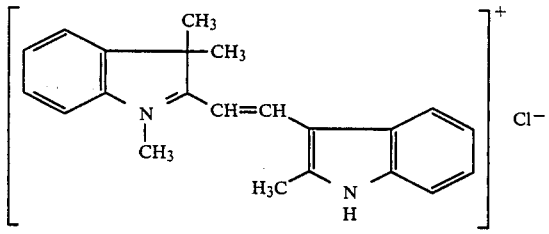

are dissolved in 1,200 ml of water, 0.8 g of a nonionic emulsifier is added, and 600 g of the sodium phosphorus tungstomolybdate solution prepared according to Example 1 are added dropwise. The mixture is stirred at 90° C. for a further 10 minutes, and, after cooling, the orange pigment formed is filtered off under suction. The press cake is dried in vacuo. Yield: 55.9 g.

A toner powder is prepared according to the method of Example 1, and the triboelectric charge is measured by the blow-off method. It is 9.6 μC/g.

A toner powder of similarly high triboelectric charge is obtained when the cationic dyestuff of the formula

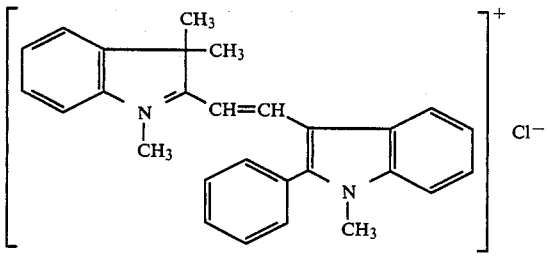

is precipitated as the phosphorus tungstomolybdate according to the method of this example.

EXAMPLE 5

30 g of the cationic dyestuff of the formula

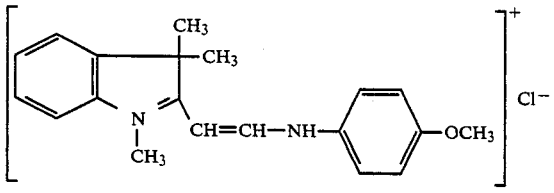

are dissolved in 1 liter of water at 90° C., and 600 g of the sodium phosphorus tungstomolybdate solution prepared by the method of Example 1 are added dropwise. The mixture is stirred at 90° C. for a further 10 minutes and cooled, and the solid is filtered off under suction and dried in vacuo. Yield: 38.0 g.

The yellow pigment is processed into a toner powder according to the method of Example 1 and the triboelectric charge is determined. According to the blow-off method, it is 4.1 μC/g.

A toner having equally good triboelectric properties is obtained when a cationic dyestuff of the above formula which carries a second methoxy group in the o-position to the amino group is precipitated as pigment in the same way and processed into a toner.

EXAMPLE 6

36 g of the cationic dyestuff of the formula

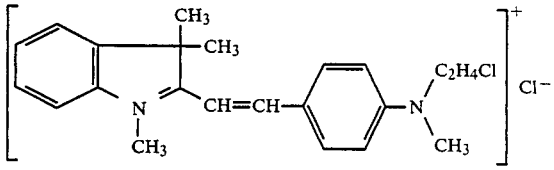

are dissolved in 1.2 liters of water at 85° C., and 500 g of the sodium phosphorus tungstomolybdate solution prepared according to Example 1 are added dropwise at 90° C. The mixture is stirred at 90° C. for a further 10 minutes, and cooled to room temperature, and the pigment is filtered off under suction and dried in vacuo at 50° C. Yield: 55.0 g.

The red pigment is processed into a toner powder according to the method of Example 1, and the triboelectric charge is determined by the blow-off method. It is 5.3 μC/g.

Toner powders having equally good triboelectric charge are obtained when pigments are employed which are prepared from cationic dyestuffs of the above formula which are substituted in the p-position to the nitrogen of the indolenine radical by methyl, methoxy or chlorine.

The following cationic dyestuffs were employed with equally good results:

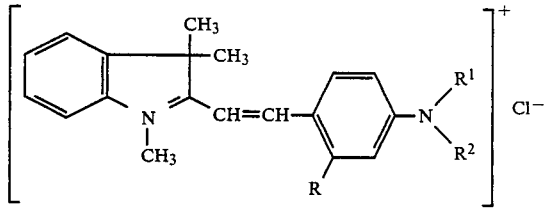

where R=H, $R^1=R^2=C_2H_5$,
where R=H, $R^1=C_2H_4CN$, $R^2=CH_3$, and
where $R=CH_3$, $R^1=C_2H_4CN$, $R^2=C_2H_5$.

EXAMPLE 7

16 g of the cationic dyestuff of the formula

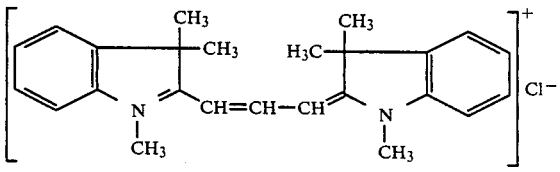

are dissolved in 2.5 liters of water at 85° C., and 132 g of the solution of the sodium phosphorus tungstomolybdate whose preparation is given in Example 1 are added.

The mixture is stirred at room temperature for 6 hours, and the pigment is filtered off under suction and dried at 50° C. in vacuo. Yield: 24.5 g. A toner powder is prepared by the method of Example 1, and the triboelectric charge is determined by the blow-off method. It is 6.1 μC/g.

Similarly good toners are obtained from dyestuffs of the above formula in which the indolenine rings are substituted in the p-position to nitrogen by methyl, methoxy or chlorine.

EXAMPLE 8

Preparation of a sodium silicomolybdate solution 900 ml of water are warmed to 30° C., 82.5 g of sodium molybdate dihydrate and 9.9 g of sodium metasilicate pentahydrate are added, and the solution is stirred at 30° C. for 10 minutes. 0.9 g of sodium dichromate is added, and the pH is adjusted to 2.5 to 2.6 by dropwise addition of 64 ml of 32% strength hydrochloric acid. The mixture is stirred at 30° C. for a further 15 minutes, and diluted with water to 1,575 ml. The solution is warmed to 50° C. and stirred at 50° C. for 10 minutes.

Preparation of the pigment 30 g of the cationic dyestuff of the formula

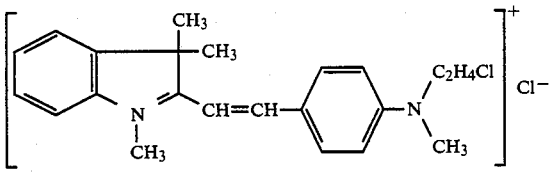

are dissolved in 1 liter of water at 50° C., and 750 ml of silicomolybdate solution whose preparation is described above are added dropwise at 50° C. The mixture is stirred at 50° C. for a further 10 minutes, the suspension is cooled, and the pigment is filtered off under suction, washed with water and dried in vacuo at 50° C. Yield: 49.9 g.

The pigment is processed into a toner powder by the method of Example 1, and the triboelectric charge is determined by the blow-off method. It is 4.4 μC/g.

Equally good toner materials are obtained when pigments are employed which have been prepared from cationic dyestuffs of the above formula in which the indolenine radical is substituted in the p-position to the nitrogen by methyl, chlorine or methoxy.

Equally good results are obtained when the following three dyestuffs are employed for the pigment preparation:

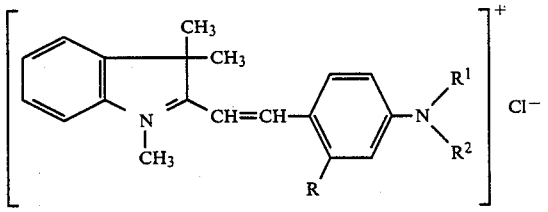

(a) R=H, $R^1=R^2=C_2H_5$
(b) R=H, $R^1=C_2H_4CN$, $R^2=CH_3$
(c) $R=CH_3$, $R^1=C_2H_4CN$, $R^2=C_2H_5$

EXAMPLE 9

30 g of the cationic dyestuff of the formula

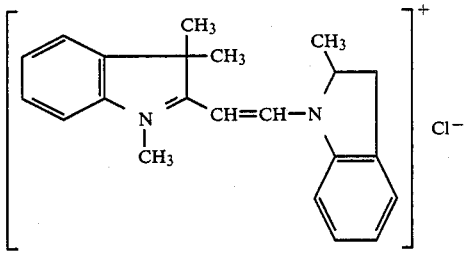

are dissolved in 1 liter of water at 50° C., and 750 ml of the silicomolybdate solution whose preparation is described in Example 8 are added dropwise. The suspension is stirred at 50° C. for a further 1 hour, and cooled, and the yellow pigment is filtered off under suction, washed with water and dried in vacuo at 50° C. Yield: 61.3 g.

The yellow pigment is processed into a toner powder by the method of Example 1, and the triboelectric charge is measured by the blow-off method. It is 3.1 μC/g.

Toner powders having similarly good triboelectric charge are obtained using pigments which have been prepared from cationic dyestuffs of the above formula in which the indolenine radical is substituted in the p-position to the nitrogen by a methoxy or a methoxycarbonyl group.

The cationic dyestuffs of the formulae:

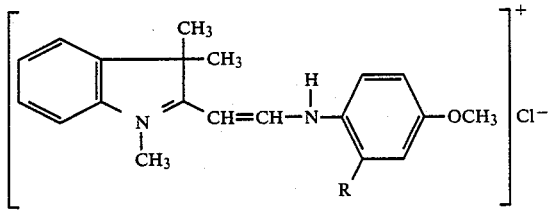

where R=H or $OCH_3$

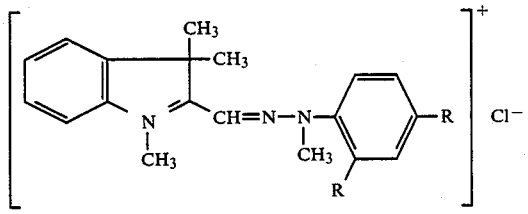

where R=H, $CH_3$, $OCH_3$ or

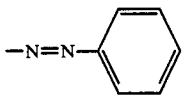

are also suitable for the preparation of yellow toner powders.

EXAMPLE 10

30 g of the cationic dyestuff of the formula

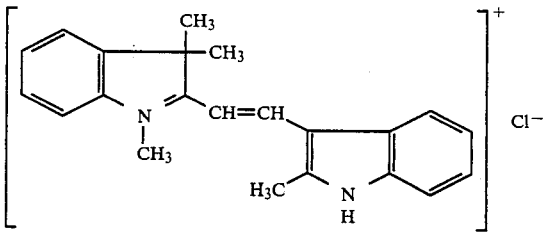

are dissolved in 1.3 liters of water at 90° C. 590 ml of silicomolybdate solution whose preparation is described in Example 8 are added dropwise at this temperature. The mixture is then stirred at 90° C. for a further 10 minutes, the suspension is cooled, and the orange pigment is filtered off under suction, washed with water and dried in vacuo at 50° C. Yield: 59.7 g.

From the pigment, an orange toner powder is prepared and its triboelectric charge measured by the blow-off method. The charge is 7.7 μC/g.

A toner powder having equally good triboelectric charge is obtained when a pigment is employed which has been prepared from the cationic dyestuff of the formula

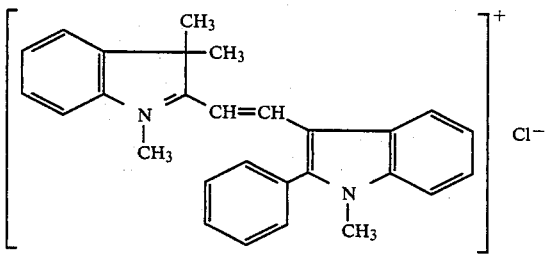

or when dyestuffs of this formula are employed in which the indolenine ring is substituted in the p-position to the nitrogen by methyl, methoxy or chlorine.

EXAMPLE 11

30 g of the cationic dyestuff of the formula

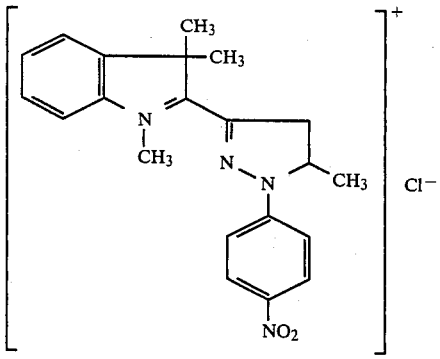

are dissolved in 1.5 liters of water and 50 ml of glacial acetic acid at 90° C., and precipitated by means of 500 ml of silicomolybdate solution whose preparation is described in Example 8. The mixture is stirred at 90° C. for a further 10 minutes, the suspension is cooled, and the red pigment is filtered off under suction, washed with water and dried in vacuo at 50° C. Yield: 51.9 g.

A toner powder is prepared from this pigment by the method of Example 1 and the triboelectric charge is examined by the blow-off method. It is 6.2 μC/g.

EXAMPLE 12

100 g of the cationic dyestuff of the formula

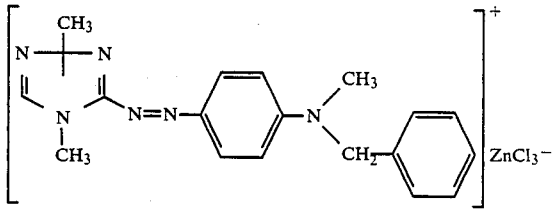

are dissolved in 1.5 liters of water at 85° C. 700 g of sodium phosphorus tungstomolybdate solution whose preparation is described in Example 1 are added dropwise at 90° C. The mixture is stirred at 90° C. for a further 10 minutes, the dyestuff suspension is cooled to room temperature, and the pigment is filtered off and dried in vacuo at 50° C. Yield: 44.6 g.

A red toner powder is prepared from this pigment by the method of Example 1 and the triboelectric charge is determind by the blow-off method. It is 9.1 μC/g.

Toners having equally good triboelectric charge are obtained using pigments which have been prepared from cationic dyestuffs of the formula

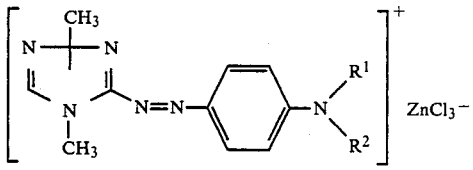

$R^1=R^2=CH_3$
$R^1=R^2=C_2H_5$
$R^1=R^2=C_4H_9$
$R^1=C_2H_5$, $R^2=$

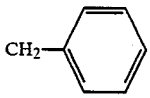

$R^1=CH_3$, $R^2=$

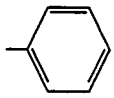

EXAMPLE 13

20 g of the cationic dyestuff of the formula

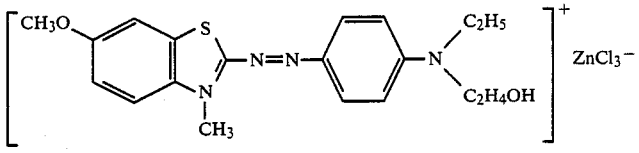

are dissolved in 1.5 liters of water at 85° C. 600 g of a solution of sodium phosphorus tungstomolybdate whose preparation is described in Example 1 are added at 90° C., and the mixture is stirred at 90° C. for a further 10 minutes. After the mixture has been cooled to room temperature, the pigment suspension is filtered off under suction and the pigment is dried in vacuo at 50° C. Yield: 17.7 g.

A blue toner powder is prepared from the pigment by the method of Example 1 and the triboelectric charge is determined by the blow-off method. It is 8.8 μC/g.

Toner powders having similarly good triboelectric charge are obtained using pigments which have been prepared from cationic dyestuffs of the following formula:

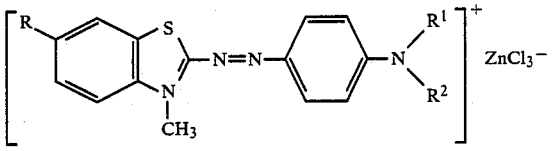

$R=OCH_3$, $R^1=R^2=CH_3$
$R=OC_2H_5$, $R^1=R^2=C_2H_5$
$R=OCH_3$, $R^1=C_2H_4CN$, $R^2=C_4H_9$
$R=H$, $R^1=R^2=CH_3$
$R=OCH_3$, $R^1=CH_3$, $R^2=C_6H_5$.

EXAMPLE 14

20 g of the cationic dyestuff of the formula

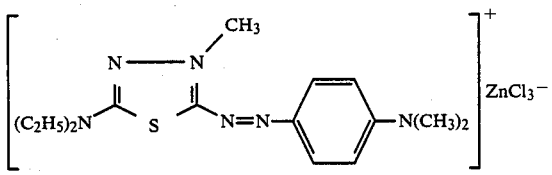

are dissolved in 0.5 liter of water at 85° C. 250 g of a solution of sodium phosphorus tungstomolybdate whose preparation is described in Example 1 are added dropwise within 15 minutes at 90° C. The mixture is stirred at 90° C. for a further 10 minutes, the pigment suspension is cooled to room temperature, and the pigment is filtered off under suction and dried in vacuo at 50° C. Yield: 17.6 g.

A blue toner powder is prepared from this pigment by the method of Example 1 and the triboelectric charge is tested. It is 8.9 μC/g.

Toner powders having equally good triboelectric charge are obtained using pigments which have been prepared from cationic dyestuffs of the following formula:

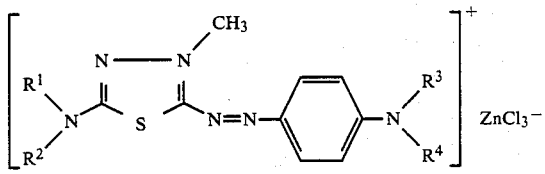

$R^1=R^2=C_3H_7$, $R^3=R^4=C_2H_5$
$R^1=C_2H_4OH$, $R^2=C_2H_5$, $R^3=C_2H_5$
$R^1=R^2=C_2H_4OH$, $R^3=C_2H_4CN$, $R^4=CH_3$
$R^1=C_2H_4OH$, $R^2=CH_3$, $R^3=CH_3$, $R^4=$

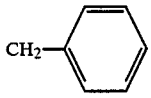

We claim:

1. Positively chargeable dry toner for electrostatic recording and printing methods, which contains, as charge-control substance, a pigment of the general formula

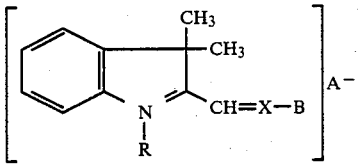

in which $A^-$ represents an anion of a heteropolyacid based on tungsten and/or molybdenum with phosphorus, silicon, vanadium, cobalt, aluminium, manganese, chromium and/or nickel or a copper(I) hexacyanoferrate anion R represents alkyl or aralkyl, X represents CH or N, and B represents a radical of the formula

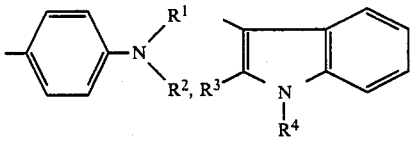

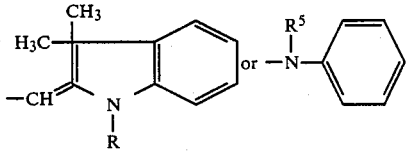

in which $R^1$ denotes alkyl or aralkyl, $R^2$ denotes alkyl, aralkyl or aryl, or $R^1$ and $R^2$, independently of one another, denote, through linking with the o-position of the phenylene radical, the members of a partly hydrogenated five- or six-membered ring, or $R^1$ and $R^2$ together denote the members of a five- or six-membered ring, $R^3$ denotes hydrogen, alkyl or aryl, $R^4$ denotes hydrogen, alkyl or aralkyl, and $R^5$ denotes hydrogen or alkyl or, through linking with the o-position of the phenyl radical, the members of a partly hydrogenated 5- or 6-membered ring, and in which the alkyl, aralkyl and aryl radicals and the aromatic rings may be substituted by the nonionic groups which are conventional in dyestuffs chemistry.

2. Positively chargeable dry toner for electrostatic recording and printing methods, which contains, as charge-control substance, a pigment of the general formula

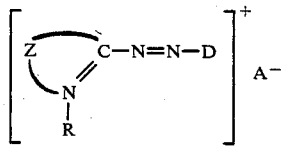

in which $A^-$ represents an anion of a heteropolyacid based on tungsten and/or molybdenum with phosphorus, silicon, vanadium, cobalt, aluminium, manganese, chromium and/or nickel or a copper(I) hexacyanoferrate anion Z represents the remaining members of a triazole, thiazole, benzothiazole, thiadiazole, imidazole, benzimidazole, pyrazole, indazole, pyridine or quinoline ring, and D represents a

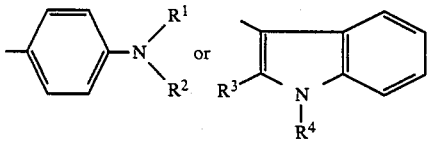

radical in which $R^1$ denotes alkyl or aralkyl, $R^2$ denotes alkyl, aralkyl or aryl, or $R^1$ and $R^2$, independently of one another, denote, through linking with the o-position of the phenylene radical, the members of a partly hydrogenated five- or six-membered ring, or $R^1$ and $R^2$ together denote the members of a five- or six-membered ring, $R^3$ denotes hydrogen, alkyl or aryl, $R^4$ denotes hydrogen, alkyl or aralkyl, and and in which the alkyl, aralkyl and aryl radicals and the aromatic rings may be substituted by the nonionic groups which are conventional in dyestuffs chemistry.

3. Positively chargeable dry toner according to claim 2, which contains a binder resin.

4. Positively chargeable dry toner according to claim 1, which contains, as charge-control substance, a pigment of the general formula

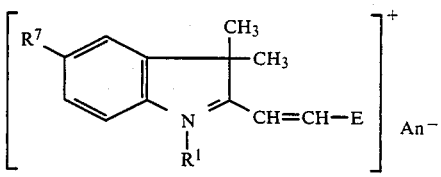

in which

E represents a

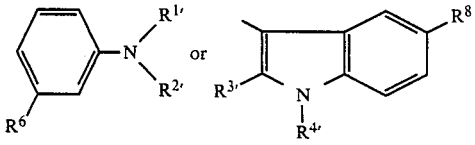

radical,

R′ represents methyl or ethyl, $R^{1'}$ represents a $C_1$- to $C_4$-alkyl radical which is optionally substituted by chlorine, cyano or $C_1$- to $C_4$-alkoxy, or a benzyl radical, $R^{2'}$ represents the substituents mentioned in the case of $R^{1'}$ or a phenyl radical which is optionally substituted by methyl, chlorine or $C_1$- to $C_4$-alkoxy, $R^{3'}$ represents hydrogen, methyl or phenyl, $R^{4'}$ represents hydrogen or $C_1$- to $C_4$-alkyl which is optionally substituted by chlorine, cyano or $C_1$- to $C_4$-alkoxy, $R^6$ represents hydrogen, methyl, chlorine or $C_1$- to $C_4$-alkoxy, $R^7$ represents hydrogen, methyl, chlorine, $C_1$- to $C_4$-alkoxy, cyano, nitro, acetylamino, $C_1$- to $C_4$-alkylsulphonyl, phenylsulphonyl or $C_1$- to $C_4$-alkoxycarbonyl, $R^8$ represents hydrogen, methyl, chlorine or $C_1$- to $C_4$-alkoxy, and $An^-$ represents the anion of a heteropolyacid based on phosphorus, molybdenum, tungsten and/or silica.

5. Positively chargeable dry toner according to claim 1, which contains, as charge-control substance, a pigment of the general formula

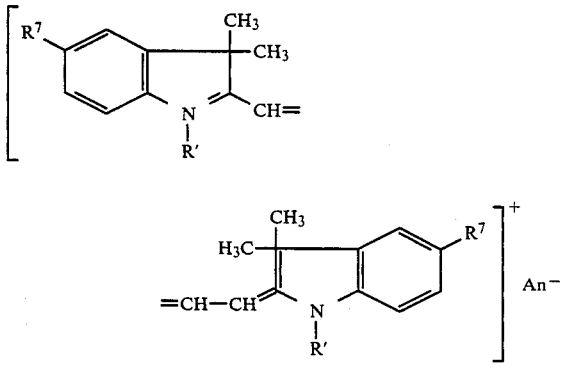

in which

R′, $R^7$ and $An^-$ have the abovementioned meaning.

6. Positively chargeable dry toner according to claim 1, which contains, as charge-control substance, a pigment of the general formula

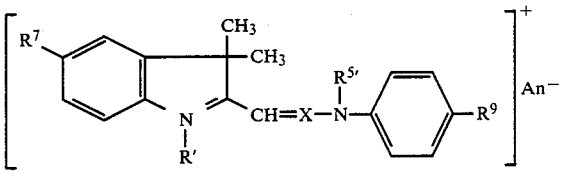

in which $R^{5'}$ represents hydrogen, a $C_1$- to $C_4$-alkyl radical which is optionally substituted by chlorine, cyano or $C_1$- to $C_4$-alkoxy, or, through ring closure in the o-position to the phenylene radical, forms, with the latter, an indoline, tetrahydroquinoline or dihydrobenzoxazine ring which may be substituted by $C_1$- to $C_4$-alkyl, $R^9$ represents hydrogen, chlorine, methyl, $C_1$- to $C_4$-alkoxy, benzyl, benzyloxy, amino or acetylamino, and the $R'$, $R^7$, X and $An^-$ radicals have the abovementioned meaning.

7. Positively chargeable dry toner according to claim 2, which contains, as charge-control substance, a pigment of the general formula

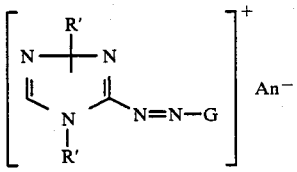

in which

G represents a

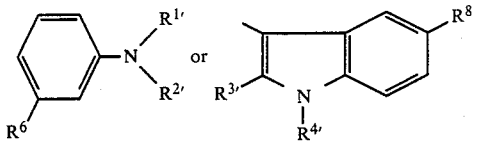

radical and $R'$, $R^{1'}$, $R^{2'}$, $R^{3'}$, $R^{4'}$, $R^6$, $R^8$ and $An^-$ have the meaning given in claim 4.

8. Positively chargeable dry toner according to claim 2, which contains, as charge-control substance, a pigment of the general formula

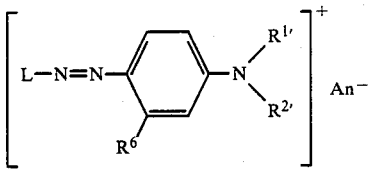

in which

L represents a

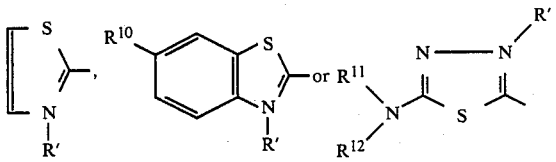

radical, $R^{10}$ represents hydrogen, methyl, chlorine, $C_1$- to $C_4$-alkoxy or $C_1$- to $C_4$-alkylcarbonylamino, and $R^{11}$ and $R^{12}$ represent $C_1$–$C_6$-alkyl, and $R'$ represents methyl or ethyl, $R^{1'}$ represents a $C_1$- to $C_4$-alkyl radical which is optionally substituted by chlorine, cyano or $C_1$- to $C_4$-alkoxy, or a benzyl radical, $R^{2'}$ represents the substituents mentioned in the case of $R^{1'}$ or a phenyl radical which is $R^6$ represents hydrogen, methyl, chlorine or $C_1$- to $C_4$-alkoxy, $An^-$ represents the anion of a heteropolyacid based on phosphorus, molybdenum, tungsten and/or silica.

9. Positively chargeable dry toner according to claim 1, which contains a binder resin.

* * * * *

UNITED STATES PATENT AND TRADEMARK OFFICE

CERTIFICATE OF CORRECTION

PATENT NO. : 4,849,306

DATED : July 18, 1989

INVENTOR(S) : Roderich Raue, et al

It is certified that error appears in the above-identified patent and that said Letters Patent is hereby corrected as shown below:

Col. 3, line 55 — Middle of formula move bonding line as follows:

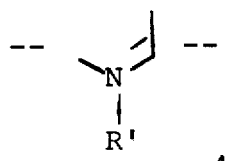

Col. 16, line 20 — After "$C_2H_5$, $R^3$=" insert --$R^4$= --

Col. 20, line 1 — Delete first formula and substitute:

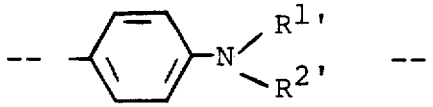

Signed and Sealed this

Twenty-first Day of August, 1990

*Attest:*

*Attesting Officer*

HARRY F. MANBECK, JR.

*Commissioner of Patents and Trademarks*